US006981345B1

(12) United States Patent
Gunn et al.

(10) Patent No.: US 6,981,345 B1
(45) Date of Patent: Jan. 3, 2006

(54) TOOL FOR CLEANING AND LOADING RIFLES

(76) Inventors: Philip Ervin Gunn, 12130 Spring Run Rd., Chesterfield, VA (US) 23832; Barry L. Graves, 2051 Flint Hill Rd., Powhatan, VA (US) 23139

( * ) Notice: Subject to any disclaimer, the term of this patent is extended or adjusted under 35 U.S.C. 154(b) by 59 days.

(21) Appl. No.: 10/865,166

(22) Filed: Jun. 10, 2004

(51) Int. Cl.
*F41C 27/00* (2006.01)

(52) U.S. Cl. ..... 42/90; 42/95

(58) Field of Classification Search ..... 42/90, 42/95; 15/104.165
See application file for complete search history.

(56) References Cited

U.S. PATENT DOCUMENTS

| | | | | |
|---|---|---|---|---|
| 17,233 | A | 5/1857 | Read | |
| 484,099 | A | 12/1891 | Wehrstedt | |
| 553,472 | A | 1/1896 | Keller | |
| 860,180 | A | 7/1907 | Alrd | |
| 877,778 | A | 1/1908 | Kauffman | |
| 1,008,548 | A | 11/1911 | King | |
| 1,133,571 | A | 3/1915 | Niedner | |
| 1,251,247 | A | 12/1917 | Lanfranco | |
| 1,450,037 | A | 3/1923 | Heiman | |
| 2,544,150 | A | 3/1951 | Franklin | |
| 2,616,109 | A | 11/1952 | Gardner | |
| 3,208,302 | A | 9/1965 | Lewis et al. | |
| 3,602,935 | A | 9/1971 | McDonnell | |
| 3,814,525 | A | 6/1974 | Spencer | |
| 4,144,609 | A | 3/1979 | Dubs | |
| 4,184,220 | A | 1/1980 | Coyle | |
| 4,195,381 | A | 4/1980 | Jurich, III | |
| 4,399,627 | A | 8/1983 | Malesky et al. | |
| 4,466,209 | A | 8/1984 | Strickland et al. | |
| 4,499,625 | A | 2/1985 | Bottomley | |
| 4,547,924 | A | 10/1985 | Brygider | |
| 4,674,218 | A | 6/1987 | Bottomley | |
| 4,680,824 | A | 7/1987 | Lieptz | |
| 4,716,673 | A | 1/1988 | Williams et al. | |
| 4,803,792 | A * | 2/1989 | Brown et al. | 42/95 |
| 4,817,321 | A | 4/1989 | Clement | |
| 4,858,360 | A | 8/1989 | Hardin | |
| 4,866,871 | A | 9/1989 | Rivers | |
| 4,890,406 | A | 1/1990 | French | |
| 4,930,240 | A | 6/1990 | Bice | |
| 5,075,998 | A | 12/1991 | Selleck | |
| 5,127,179 | A | 7/1992 | Marsh | |
| 5,204,483 | A | 4/1993 | Tellechea | |
| 5,233,124 | A * | 8/1993 | Peterson | 86/1.1 |
| 5,446,987 | A | 9/1995 | Lee et al. | |
| 5,628,136 | A | 5/1997 | Wickser, Jr. | |
| 5,651,207 | A | 7/1997 | Knight | |
| 5,836,099 | A | 11/1998 | Pace et al. | |

(Continued)

FOREIGN PATENT DOCUMENTS

DE 3714030 A1 4/1987

(Continued)

*Primary Examiner*—J. Woodrow Eldred
(74) *Attorney, Agent, or Firm*—John H. Thomas

(57) ABSTRACT

A tool for cleaning and loading muzzle loading rifles includes a tube having a longitudinal axis and a centered throughbore along the axis. The tube includes a head having a knurled outer surface and a front face recess. The recess is adapted to center and support the projectile. A shaft is mounted in the throughbore of the tube and protrudes out of the back of the tube, wherein the diameter of the shaft is less than the diameter of the throughbore. Accordingly, when the shaft is fixed to a cleaning rod, the tube is free to rotate on the shaft.

18 Claims, 3 Drawing Sheets

U.S. PATENT DOCUMENTS

| | | | | |
|---|---|---|---|---|
| 5,987,799 | A | 11/1999 | Dedeaux et al. | |
| 6,145,235 | A * | 11/2000 | Emerson et al. | 42/90 |
| 6,336,284 | B1 * | 1/2002 | Rotell et al. | 42/90 |
| 6,378,236 | B1 * | 4/2002 | Solberg et al. | 42/95 |
| 6,691,446 | B2 | 2/2004 | Graves | |
| 2002/0058219 | A1 | 5/2002 | Solberg et al. | |
| 2003/0233779 | A1 | 12/2003 | Graves | |
| 2004/0074523 | A1 | 4/2004 | Paananen et al. | |

FOREIGN PATENT DOCUMENTS

| | | | |
|---|---|---|---|
| DE | 3634119 | A1 | 4/1988 |
| GB | 2034431 | | 6/1980 |
| JP | 2000312868 | | 11/2000 |

* cited by examiner

TOOL FOR CLEANING AND LOADING RIFLES

The present invention relates to tools for cleaning and loading rifles. Specifically, the invention is a combination tool that can clean the inside bore of a rifle barrel and load a projectile into the rifle barrel.

BACKGROUND

Many types of cleaning devices are known for firearms generally and rifles specifically. Many of these prior devices address various specific cleaning issues including efforts to better clean the rifling groves within the barrel of the firearm. Additionally, other ram rod devices are known to assist persons in the loading of rifles, especially black powder rifles. Each of these separate tools is necessary for the efficient operation of muzzle loading rifles.

Generally, most tools for cleaning or loading a rifle are separate tools that fasten firmly to the end of a cleaning rod. When in use, the entire cleaning rod will therefore follow the same motion as whichever tool is attached to the end of the rod. This includes the rotational movement of the tool in the rifling of the barrel of a rifle. Because the cleaning and loading tools are fixedly attached to the cleaning rods, the tools can cause excess friction and drag in both the cleaning and loading processes. These cleaning and loading rods with the fixed tools include those that are sold with and removably mounted on a rifle.

SUMMARY

Accordingly, it is an object of the present invention to overcome the foregoing drawbacks and limitations with respect to prior art rifle cleaning tools and loading tools.

In one example, a tool for cleaning and loading muzzle loading rifles comprises a tube having a longitudinal axis and a centered throughbore along the axis. The tube comprises a head, with the head having a knurled outer surface and a front face recess. The recess is adapted to support a projectile. A shaft is mounted in a throughbore of the tube and protrudes out the back of the tube. The diameter of the shaft is less than the diameter of the throughbore. The shaft is adapted to be fixed to a cleaning rod and the tube is further freely rotatable on the shaft. The tool may further include a washer and/or a self locking nut. The head may comprise the entire tube, and the entire outer surface of the head may be knurled. The recess may have a conical, convex curvature. And the tool may further comprise a cleaning rod fixed to the shaft.

In another example, a tool kit for cleaning and loading muzzle loading rifles may include a tube having a longitudinal axis and a centered throughbore along the axis. The tube comprises a head with a knurled outer surface and a front face recess, wherein the recess is adapted to support a projectile. A shaft is mountable in the throughbore of the tube, wherein the shaft is longer than the length of the throughbore. The shaft is adapted to be fixed to a cleaning rod, and the diameter of the shaft is less than the diameter of the throughbore. The tube is adapted to be rotatable on the shaft. The tool kit may further include a washer adapted to be rotatably mounted on the shaft and/or a self-locking nut adapted to be fixed on the shaft. The entire outer surface of the head may be knurled, and the recess in the head comprises a conical, convex curvature. The tool kit may further comprise a cleaning rod adapted to be fixed to the shaft.

DETAILED DESCRIPTION

The present invention is directed to a combination tool for use with muzzle loading rifles. The tool includes a tube that may both support a cleaning patch or a projectile to be loaded into a rifle. The floating tube will rotate within the barrel of the rifle to follow the rifling grooves therein. The knurled head secures the cleaning cloth or patching. The recess on the front face supports and centers the rounded edge of a projectile during loading.

Figure 1:
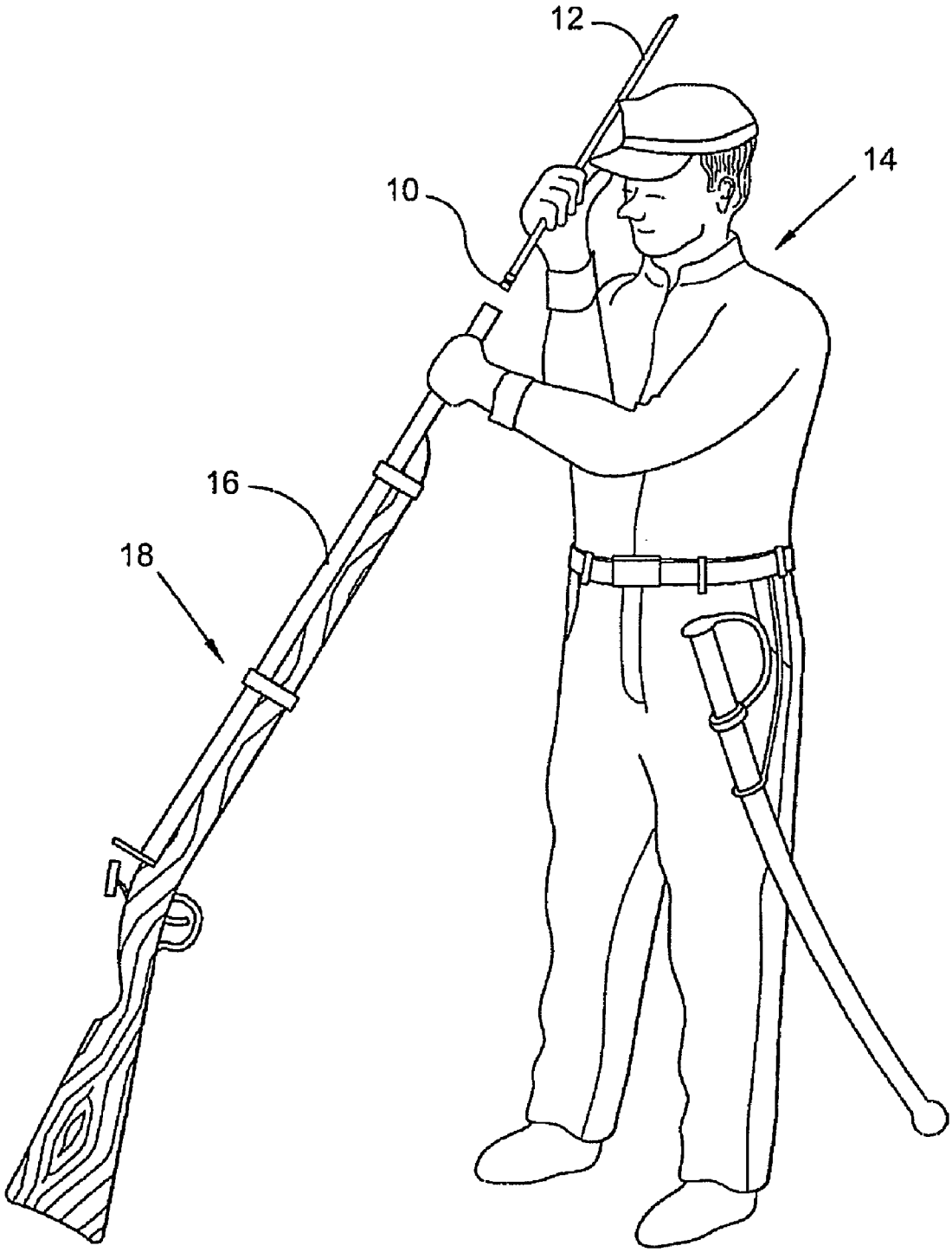
FIG. 1 is an environmental, perspective view of a man using the cleaning and loading tool for a muzzle loading, black powder rifle in accordance with the present invention.

Turning now to the drawings, FIG. 1 depicts a reenactor soldier 14 using the tool 10 at the end of a cleaning rod 12. The tool 10 maybe used to clean or load the rifle 18 by inserting the tool down the rifle barrel 16.

Figure 2:
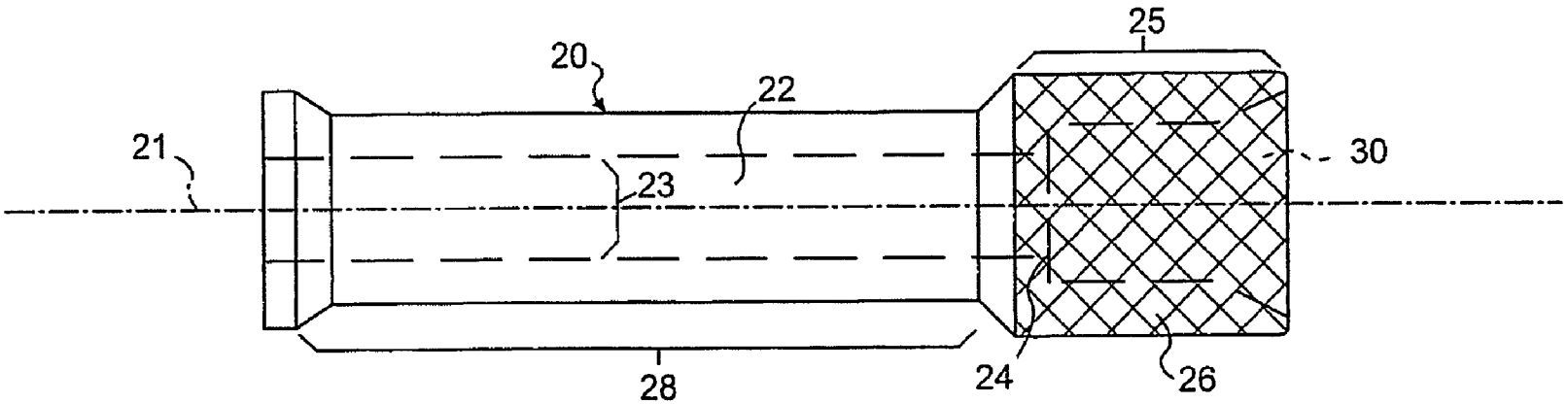
FIG. 2 is a side elevation view of the tube portion of the tool described herein.

FIG. 2 shows an example of a tube 20 in accordance with the present invention. The tube 20 has a longitudinal axis 21. The tube 20 includes a centered throughbore 22 along the longitudinal axis 21. The throughbore 22 includes a shoulder portion 24 at the end of the tube where the head 25 is located.

The tube 20 includes a head 25 that constitutes the front end of the tube. As shown, the tube 20 has a reduced diameter portion 28 behind the head 25. This construction is preferred to allow the patching material to bunch behind the head 25 during cleaning. Alternatively, the head 25 could be the entire tube 20. The outer surface 26 of the tube is knurled. Either a portion or all of the outer surface 26 may be knurled. As shown, the knurling is obtained by a cross-hatch design. Obviously, the knurling may include any roughening or unevenness on the surface 26 of the head 25.

The head 25 includes a recess 30 on the front face of the head. As shown, the recess 30 has a conical, convex curvature. The recess 30 is adapted to center and support a projectile that may be loaded in a rifle. Other geometries of the recess 30 may be equally effective to hold or support the pointed or rounded projectile that could be loaded in a rifle.

Figure 3:
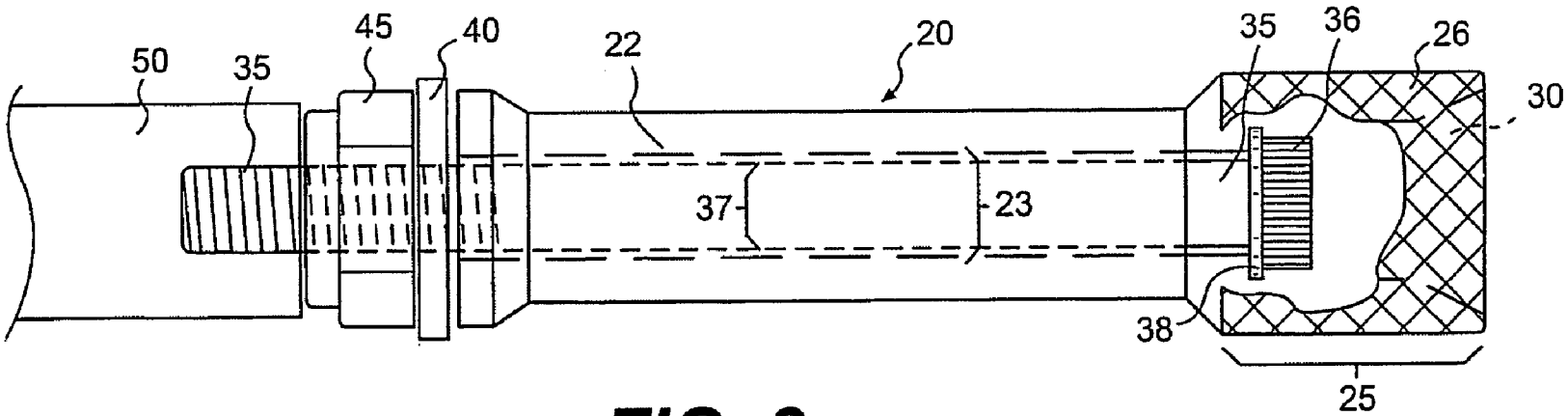
FIG. 3 is a side elevation view of the tool in accordance with the present invention.

FIG. 3 shows the tube 20 with the shaft 35 mounted in the throughbore 22. The diameter 37 of the shaft 35 is less than the diameter 23 of the throughbore 22. This difference in diameters allows the tube 20 to rotate freely on the shaft 35. The length of the shaft 35 is such that it extends out the back of the tube 20. The top 36 of the shaft 35 retains the tube 20 by being wider than the diameter 23 of the shaft and by being abuttable against the shoulder portion 24 of the throughbore 22. Alternatively, as shown, a plastic washer 38 is mounted on the shaft 35 under the top 36 to prevent the shaft top from damaging the tube 20.

Also shown in FIG. 3 is a washer 40 that is rotatably mounted on the shaft 35 adjacent to 20. The washer 40 has about the same, or alternatively, slightly larger, diameter as the head 25. This similar diameter allows the washer 40 and tube 20 to stay centered in the rifle barrel. A nut 45 is fixably mounted onto the shaft 35 adjacent to washer 40 and on the opposite side of the washer from the tube 20. The nut 45 is a self-locking nut. The nut 45 is fixed on the shaft 35 at such a position as to allow the tube some looseness to be rotatable on the shaft. A cleaning rod 50 is shown fixedly engaged to the shaft 35.

Figure 4:
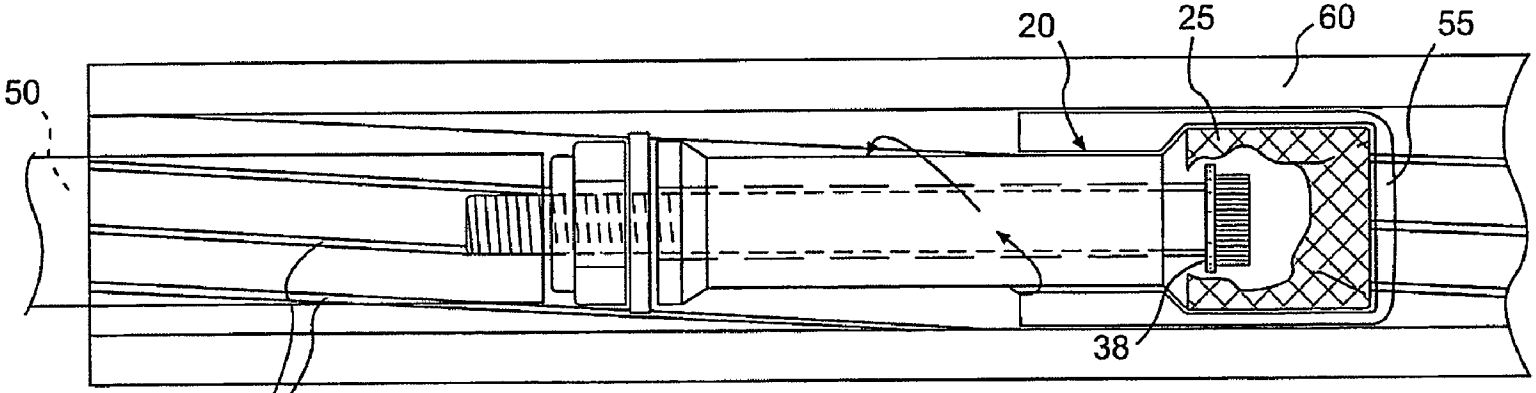
FIGS. 4 and 5 demonstrate the use of the tool in the cleaning mode (FIG. 4) and loading mode (FIG. 5).
Figure 5:
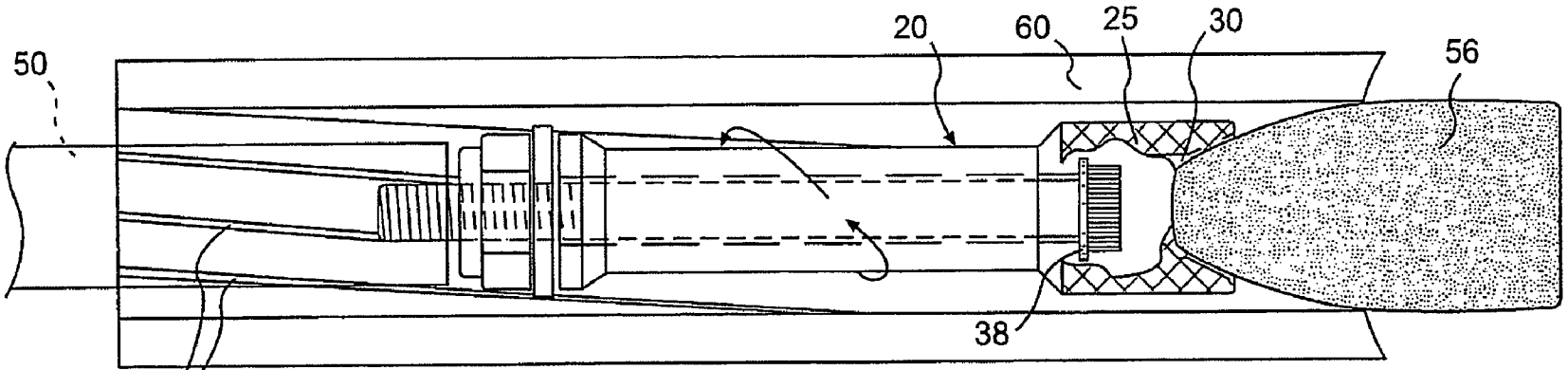

FIGS. 4 and 5 show use of the tool for cleaning (FIG. 4) and loading (FIG. 5). In FIG. 4, the head 25 of the tube 20 secures the patching cloth 55 and makes it efficiently clean the walls of the barrel 60 of the rifle. The barrel 60 also includes rifling grooves 65 that are cleaned with the patching material. The rotating feature of the tube 20 reduces the likelihood of tears and rips of the patching cloth 55 during cleaning. In FIG. 5, the recess 30 in the head 25 cradles and centers the projectile 56 as it is loaded in the barrel 60. In both the examples of cleaning and loading, the tube 20 is allowed to rotate freely with the rotation of the rifling grooves 65 down the barrel 60. The loading process is made smoother because the rotating feature of the guide means the lead bullet, for instance, that is guided down the barrel is free of rotary engraving which can otherwise result when a fixed loading tool is used. The cleaning rod 50 moves the tool in and out of the barrel 60.

The following includes sample specifications for a cleaning and loading tool to be used in connection with a 0.50 caliber rifle. The cleaning rod has 8-32 UNC regular female threads that attach to the tool. The tool includes a brass tube that is 1.875 inches long by 0.45 inches in diameter. The head of the tube is knurled to a medium surface roughness for a length of 0.525 inches. The recess in the head portion is machined to a 0.285 inch diameter for a depth of 0.437 inches. The taper of the recess is 21.5 degrees to a 0.365 inch diameter at the face of the recess. The throughbore that extends through the tube has a diameter of 0.173 inches. Behind the head of the tube is a reduced diameter portion that has a diameter of 0.31 inches. At the rear portion of the tube the brass increases to a diameter of 0.4 inches. An 8-32 UNC socket head cap screw 2 inches long made of 18-8 stainless steel acts a shaft. A nylon washer has an outside diameter of 0.406 inches to 0.499 inches by 0.062 inches thick. The variance of the outside diameter of the washer accommodates the fit of the tool central to the throughbore when a specific size patch material is used to clean the rifle. An 8-32 UNC nylock self-locking nut is made of 8-18 stainless steel.

As is evident from the foregoing, the tool may be offered as a disassembled tool kit that includes the brass tube, the washer, the nut, and a threaded shaft that may be sold separately or together with a cleaning rod onto which it may be mounted. A benefit of the particular example of this tool described above includes its rust-free characteristics, thereby making the tool essentially maintenance free.

While the invention has been described with reference to specific embodiments thereof, it will be understood that numerous variations, modifications and additional embodiments are possible, and all such variations, modifications, and embodiments are to be regarded as being within the spirit and scope of the invention.

What is claimed is:

1. A tool for cleaning and loading muzzle loading rifles, the tool comprising:

a tube having a longitudinal axis and a centered throughbore along the axis, the tube comprising a head;

the head comprising a knurled outer surface and a front face recess, wherein the recess is adapted to support a projectile;

a shaft mounted in the throughbore of the tube and protruding out the back of the tube, wherein the diameter of the shaft is less than the diameter of the throughbore;

wherein the shaft is adapted to be fixed to a cleaning rod, and further wherein the tube is freely rotatable on the shaft.

2. A tool as described in claim 1, wherein the head of the tube has a first diameter, and further comprising a washer adapted to be rotatably mounted on the shaft and adjacent the tube, and wherein the washer has substantially the same diameter as the diameter of the head.

3. A tool as described in claim 2, further comprising a self-locking nut adapted to be fixed on the shaft adjacent the washer and on the other side of the washer from the tube.

4. A tool as described in claim 1, wherein the shaft is a socket head cap screw.

5. A tool as described in claim 1, wherein the head comprises the entire tube.

6. A tool as described in claim 1, wherein the entire outer surface of the head is knurled.

7. A tool as described in claim 1, wherein the recess comprises a conical, convex curvature.

8. A tool as described in claim 3, wherein the self-locking nut is a Nylock nut.

9. A tool as described in claim 2, wherein the washer is nylon.

10. A tool as described in claim 1, further comprising a cleaning rod fixed to the shaft.

11. A tool kit for cleaning and loading muzzle loading rifles, the kit comprising:

a tube having a longitudinal axis and a centered throughbore along the axis, the tube comprising a head;

the head comprising a knurled outer surface and a front face recess, wherein the recess is adapted to support a projectile;

a shaft mountable in the throughbore of the tube, wherein the shaft is longer than the length of the throughbore;

wherein the shaft is adapted to be fixed to a cleaning rod, and further wherein the diameter of the shaft is less than the diameter of the throughbore, wherein the tube is adapted to be rotatable on the shaft.

12. A tool kit as described in claim 11, further comprising a washer adapted to be rotatably mounted on the shaft, wherein the washer has substantially the same diameter as the diameter of the head.

13. A tool kit as described in claim 11, further comprising a self-locking nut adapted to be fixed on the shaft.

14. A tool kit as described in claim 11, wherein the shaft is a socket head cap screw.

15. A tool kit as described in claim 11, wherein the head comprises the entire tube.

16. A tool kit as described in claim 11, wherein the entire outer surface of the head is knurled.

17. A tool kit as described in claim 11, wherein the recess comprises a conical, convex curvature.

18. A tool kit as described in claim 11, further comprising a cleaning rod adapted to be fixed to the shaft.

* * * * *